US007750873B2

(12) United States Patent
Kim

(10) Patent No.: US 7,750,873 B2
(45) Date of Patent: Jul. 6, 2010

(54) ELECTROLUMINESCENT DISPLAY DEVICE

(75) Inventor: Keum-Nam Kim, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 884 days.

(21) Appl. No.: 10/931,925

(22) Filed: Sep. 1, 2004

(65) Prior Publication Data

US 2005/0052368 A1 Mar. 10, 2005

(30) Foreign Application Priority Data

Sep. 8, 2003 (KR) ..... 10-2003-0062848

(51) Int. Cl.
*G09G 3/30* (2006.01)

(52) U.S. Cl. ..... 345/76; 345/82

(58) Field of Classification Search ..... 345/76, 345/77, 82, 83, 93, 98, 100
See application file for complete search history.

(56) References Cited

U.S. PATENT DOCUMENTS 5,303,047 A * 4/1994 Yoshida ..... 348/607
5,351,145 A * 9/1994 Miyata et al. ..... 349/48
6,175,193 B1 * 1/2001 Kishita et al. ..... 345/76
6,483,489 B1 * 11/2002 Yoo et al. ..... 345/60
6,583,775 B1 * 6/2003 Sekiya et al. ..... 345/82
7,199,778 B2 * 4/2007 Chi et al. ..... 345/98
2003/0063074 A1 * 4/2003 Kumagawa et al. ..... 345/204
2003/0231150 A1 * 12/2003 Yuki ..... 345/76
2004/0169627 A1 * 9/2004 Hong ..... 345/89

* cited by examiner

*Primary Examiner*—Kevin M Nguyen
(74) *Attorney, Agent, or Firm*—Christie, Parker & Hale, LLP

(57) ABSTRACT

An electroluminescent display (EL) where a signal distortion is reduced or prevented by introducing appropriate distortion to a scan waveform to equalize a variation of a kickback voltage. An EL display includes an organic EL panel that includes a plurality of scan lines, a plurality of data lines, and pixel circuits arranged at the intersections between the scan lines and the data lines; and a scan driver that sequentially selects the scan lines to drive a selection signal. A signal delay is introduced on at least one of an input side and an output side of the scan driver, and may be provided by a signal delay device. Alternatively, the signal delay device may be included in the scan driver, either at an input side or an output side of the shift register or the level shifter.

20 Claims, 9 Drawing Sheets

ELECTROLUMINESCENT DISPLAY DEVICE

CROSS-REFERENCE TO RELATED APPLICATION

This application claims priority to and the benefit of Korean Patent Application No. 2003-62848, filed Sep. 8, 2003 in the Korean Intellectual Property Office, the content of which is incorporated herein by reference in its entirety.

BACKGROUND OF THE INVENTION

1. Field of the Invention

The present invention relates to an electroluminescent (EL) display and, more particularly, to an EL display where a signal distortion is reduced or prevented by introducing appropriate distortion to a scan waveform of each pixel of a display device to equalize a variation of a kickback voltage.

2. Description of the Related Art

Recently, various flat panel displays with reduced weight and volume have been developed. Such flat panel displays include a Liquid Crystal Display (LCD), a Field Emission Display (FED), a Plasma Display Panel (PDP), an Electroluminescent (EL) display, and the like. These displays address the drawbacks associated with weight and volume of a Cathode Ray Tube (CRT).

Among these, in the EL display using an organic EL device, a fluorescent material and a phosphorescent material are excited using carriers, such as electrons and holes, to display image or picture. Such use of carriers to excite the fluorescent material and the phosphorescent material makes it possible to drive the organic EL device with a low DC voltage and provides an improved response time. Therefore, research on the EL display as a next generation display have recently been accelerated.

Such EL displays can be classified into a passive matrix type and an active matrix type. Of these, in the active matrix type display, a light emitting device is driven by setting a driving device in each pixel, and applying a voltage or current based on the image data of the pixel. A conventional active matrix type EL display is shown in FIG. 1.

FIG. 1 is a block diagram illustrating a conventional EL display.

The data driver 10 is connected to a plurality of data lines D1, D2, D3, . . . , such that it receives data signals from a control unit (not shown) and sends the data to an organic EL panel 40.

Further, the scan driver 20, which includes a shift register 21 that sequentially drives a selection signal and a level shifter 22 that amplifies the amplitude of the selection signal driven by the shift register 21, is connected to each scan line S(n), S(n+1) . . . . Alternatively, depending on the designer's preferences, the configuration of the shift register 21 and the level shifter 22 may be different, and/or the level shifter 22 may be included in the control unit. By way of example, the level shifter 22 may first amplify the selection signal, and then provide it to the shift register 21 for sequential driving.

When a drive control signal is supplied by the control unit (not shown), the data driver 10 sequentially selects a predetermined data line among a plurality of data lines D1, D2, D3, . . . and outputs RGB image signals to the pixels 41 through transistors M1 and M2 (referring to FIG. 2 or FIG. 5) in each pixel. Further, the scan driver 20 sequentially selects a predetermined scan line among a plurality of scan lines S(n), S(n+1) . . . and applies a scan signal Vscan to turn on the switching transistor M1 connected to one of the scan lines S(n), S(n+1) . . . . Here, the shift register 21 of the scan driver 20 selects a first scan line in response to a start signal, and sequentially applies the selection signal based on the subsequent clock signals. In addition, the level shifter 22 amplifies a low-voltage signal, outputted from the shift register 21 or the control unit (not shown), to a high-voltage signal, and thus outputs the high-voltage signal to each scan line.

FIG. 2 is a pixel circuit of the EL display of FIG. 1.

As shown in FIG. 2, a data line transmitting a pixel signal is arranged as a column, and a scan line transmitting a switching signal is arranged as a row. Further, the switching transistor M1 has a gate connected to the scan line, and a source connected to the data line. A driving transistor M2 has a gate connected to a drain of the switching transistor M1 and a source connected to an anode voltage Vdd. An anode of an organic EL device OLED is connected to a drain of the driving transistor M2. The circuit also includes a capacitor Cst connected between the gate of the driving transistor M2 and the anode voltage Vdd.

The operation of the pixel circuit 41, configured as described above, is as follows: first, when an on signal is applied through the scan line S(n), the switching transistor M1 is turned on, transmitting a data voltage transmitted through the data line to the capacitor Cst. Therefore, since the capacitor Cst stores the data voltage, although the scan line is turned off, the driving transistor M2 transmits a current corresponding to a first frame to the organic EL device (OLED) using the voltage charged in the capacitor Cst.

A timing diagram illustrating the foregoing operation is shown in FIG. 3.

The scan voltage Vscan is a selection signal transmitted through the scan line, the data voltage Vdata is a pixel signal transmitted through the data line, and the pixel voltage Vp is a voltage stored in the capacitor Cst.

In the pixel driving circuit of FIG. 2, a parasitic capacitor Cgs is generated between the gate and the drain of the switching transistor M1, and the parasitic capacitor Cgs along with a charging capacitor Cst acts as a total storage charging capacitor.

Hence, the voltage stored in the parasitic capacitor Cgs and the charging capacitor Cst when the scan voltage Vscan is applied through the scan line to turn the switching transistor M1 on, should be maintained when the switching transistor M1 is off. However, as shown in FIG. 3, when the scan voltage Vscan changes from an on voltage to an off voltage (i.e., low-to-high transition of Vscan in FIG. 3), the pixel voltage Vp is increased by a certain voltage, and one of reasons for this increase is the kickback voltage ΔVp. Here, for the Vscan signal, the on voltage is the logic low voltage for turning on the switching transistor M1, and the off voltage is the logic high voltage for turning off the switching transistor M1. The ΔVp is generated by redistribution of the charges charged into the parasitic capacitor Cgs and the charging capacitor Cst. Such redistribution takes place as the voltage is changed at both ends of the parasitic capacitor Cgs when the scan voltage changes from the on voltage to the off voltage.

By way of example, the kickback voltage ΔVp is generated when there is a mismatching of the load impedance between the input side and the output side of the scan driver 20, and the magnitude of the voltage ΔVp depends on the magnitude of the load at both the input side and the output side.

That is, the variation of signal distortion due to the kickback voltage is higher at the pixels near the scan driver than at the pixels separated from the scan driver by some distance. This is because, with the increased number of wiring and devices, an RC delay caused by the internal resistance and capacitance is reduced as the pixel becomes nearer to the scan driver. Therefore, in the conventional organic EL panel, there is a difference in a signal distortion range due to the kickback phenomenon, such that the luminance of the organic EL devices in the organic EL panel is not uniform.

SUMMARY OF THE INVENTION

In exemplary embodiments of the present invention, an EL display having a uniform luminance is provided by implementing a signal delay device at a position near the scan driver to generate appropriate distortion to a scan waveform of each pixel, thus equalizing the variation of a kickback voltage due to the distance between the scan driver and the pixels.

In an exemplary embodiment of the present invention, there is provided an EL display comprising an organic EL panel that includes a plurality of scan lines, a plurality of data lines, and pixel circuits arranged at the intersections between the scan lines and the data lines; and a scan driver that sequentially selects the scan lines to drive a selection signal. A signal delay is introduced on at least one of an input side and an output side of the scan driver.

The scan driver may include a shift register that selects the scan lines; and a level shifter that amplifies the amplitude of a signal transmitted by the shift register, wherein the scan driver further includes a signal delay device for providing said signal delay at an output side of at least one of the shift register and the level shifter.

Further, the scan driver comprises a shift register that selects the scan lines; and a level shifter that amplifies the amplitude of a signal transmitted by the shift register, wherein the scan driver further includes a signal delay device for providing said signal delay at an input side of at least one of the shift register and the level shifter.

The signal delay device may be an impedance device including one or more of a resistor, a capacitor and an inductor.

In another exemplary embodiment of the present invention, is provided a method of making a luminance of organic electroluminescent (EL) devices in an organic EL panel substantially uniform, the organic EL panel being driven by a scan driver. A selection signal is generated in the scan driver for selecting a row of the organic EL devices. A data signal for providing data to a column of the organic EL devices is generated. A delay is introduced to the selection signal such that a driving current becomes substantially the same across the row of the organic EL devices.

BRIEF DESCRIPTION OF THE DRAWINGS

The above and other features of the present invention will become more apparent to those of ordinary skill in the art with the description of certain exemplary embodiments thereof in detail with reference to the attached drawings in which.

DETAILED DESCRIPTION

Figure 1:
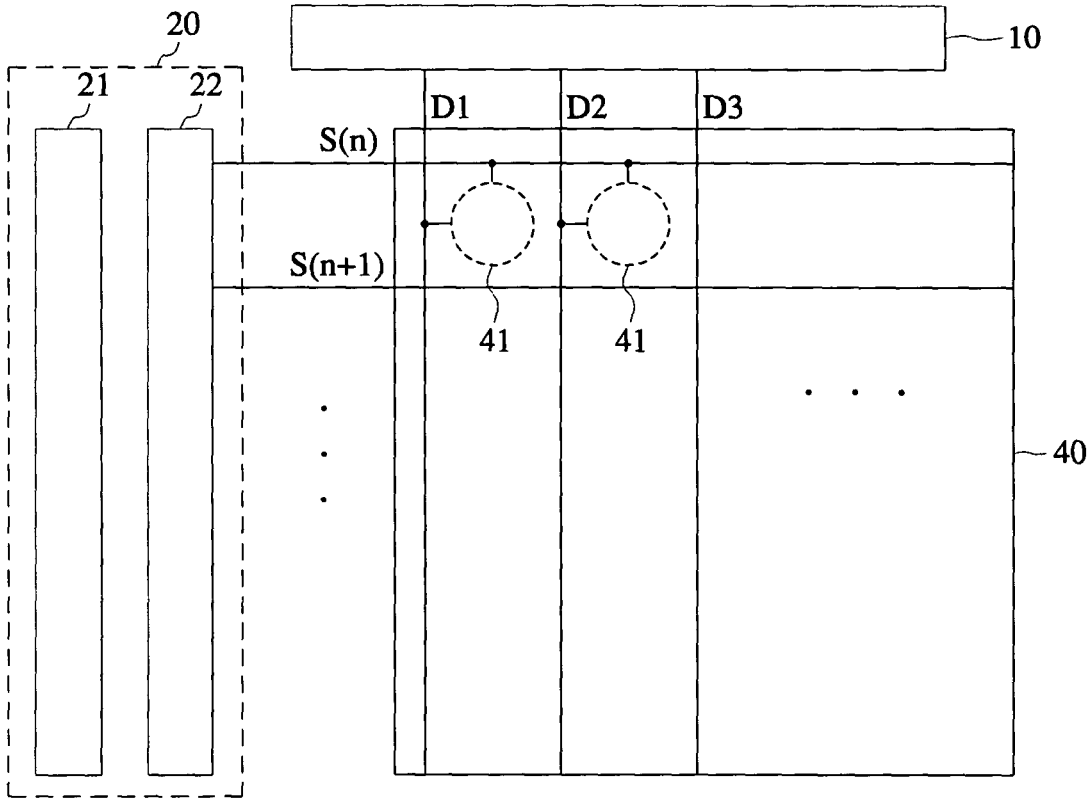
FIG. 1 (PRIOR ART)
FIG. 1 is a schematic diagram of a conventional active matrix type EL display.
Figure 2:
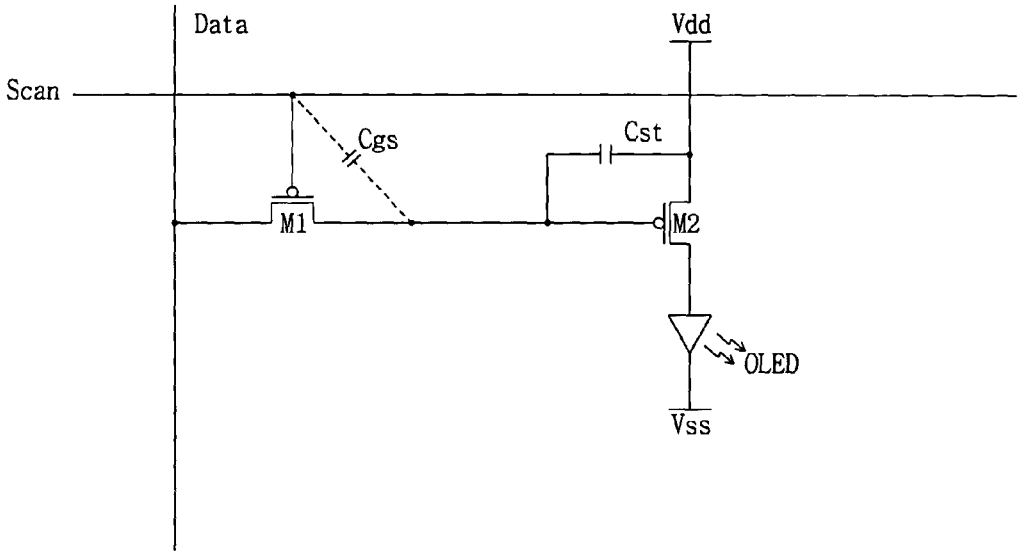
FIG. 2 (PRIOR ART)
FIG. 2 is a circuit diagram of a pixel of FIG. 1.
Figure 3:
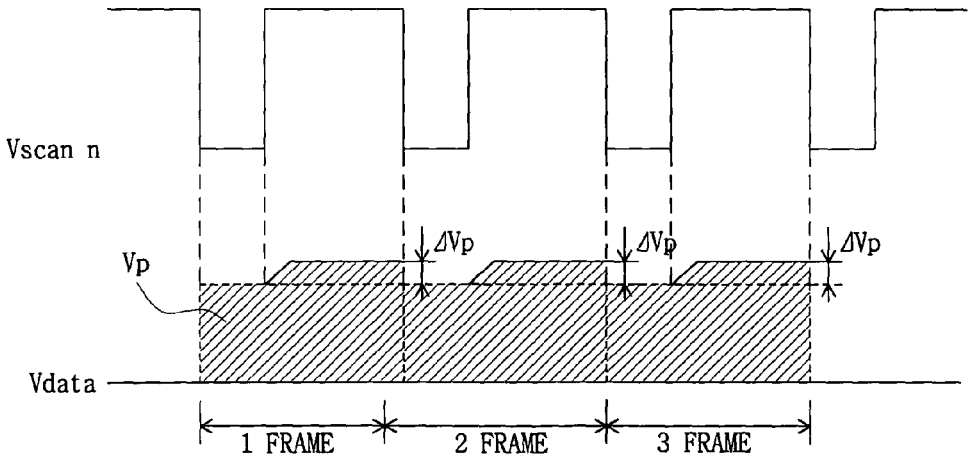
FIG. 3 (PRIOR ART)
FIG. 3 is a timing diagram illustrating a kickback phenomenon.

The present invention will now be described more fully hereinafter with reference to the accompanying drawings, in which certain exemplary embodiments of the invention are shown. The present invention may, however, be embodied in different forms and should not be construed as limited to the exemplary embodiments set forth herein. In the drawings, the thickness of layers and regions are exaggerated for clarity. Like reference numerals designate like elements throughout the specification.

Figure 4:
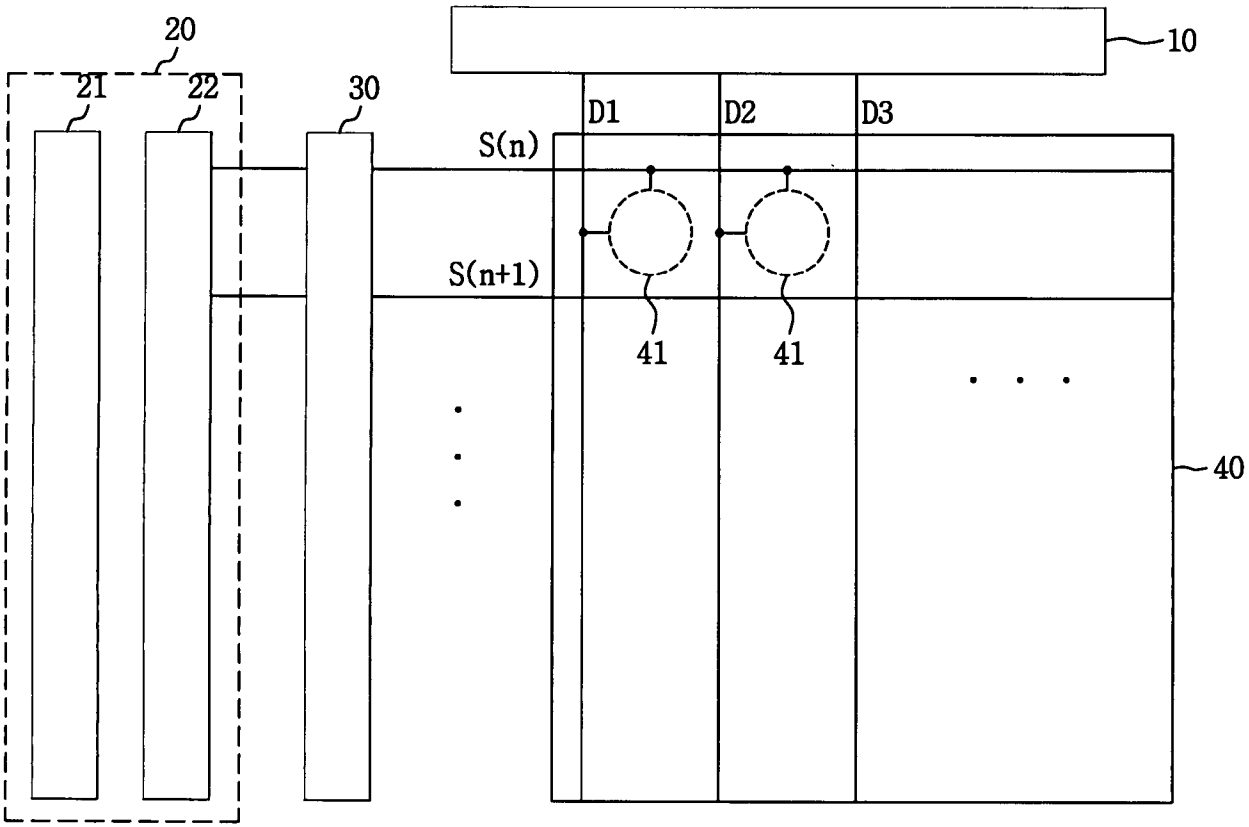
FIG. 4 is a block diagram illustrating a first exemplary embodiment of the EL display according to the present invention.

FIG. 4 is a block diagram illustrating a first exemplary embodiment of an EL display in accordance with the present invention. The components of the EL display of FIG. 4 that correspond to the components of the EL display of FIG. 1 will not be discussed with the understanding that they have substantially the same structure and operate in substantially the same manner as the corresponding components in the EL display of FIG. 1.

In addition to the components of the conventional EL display of FIG. 1, the EL display of FIG. 4 includes a signal delay device 30 connected between a level shifter 22 and an organic EL panel 40 to match the impedance between the scan driver 20 and the organic EL panel 40.

When a driving signal is applied from a control unit (not shown), the scan driver 20 sequentially selects a predetermined scan line among a plurality of scan lines S(n), S(n+1) . . . by driving the shift register 21 and applies the scan signal Vscan, thereby selecting a pixel circuit 41. Further, the level shifter 22 amplifies a low voltage signal outputted from the shift register 21 to a high voltage signal, and outputs the high voltage signal on each scan line.

The selection signal amplified by the level shifter 22 as described above is applied to the scan line S(n) through the signal delay device 30. The signal delay device 30 introduces an RC delay and delays pulse rising due to a kickback voltage $\Delta Vp$. By way of example, the signal delay device 30 should be an impedance device. Since the signal delay device 30 in essence provides impedance matching, it may also be referred to as an impedance matching device.

Figure 5:
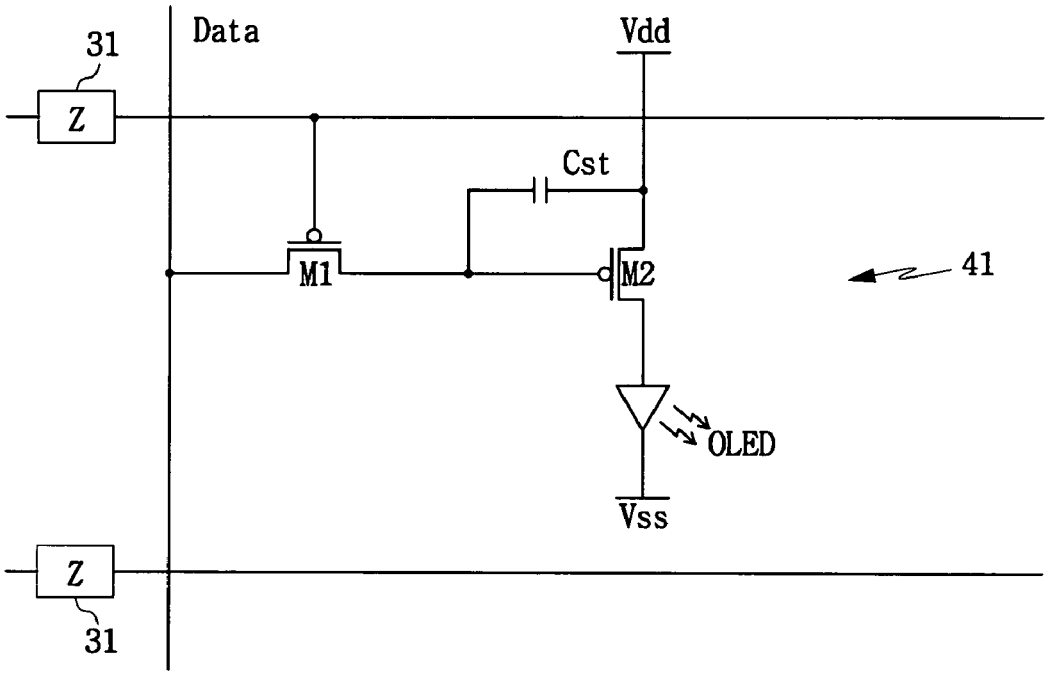
FIG. 5 is a circuit diagram illustrating a pixel attached to impedance devices.

FIG. 5 is a detailed circuit diagram illustrating a pixel 41 attached to an impedance device 31. The impedance device 31 operates as the signal delay device 30 of FIG. 4.

When a selection signal is applied from the shift register 21 (referring back to FIG. 4), the level shifter 22 (referring back to FIG. 4) raises the level of the selection signal, and outputs the amplified selection signal to each scan line S(n), S(n+1) . . . Therefore, the switching transistor M1 is turned on to transmit the data voltage applied on a data line to a storage capacitor Cst. Here, for the data voltage charged into the storage capacitor Cst, a rising time of a pulse is delayed as an RC delay due to the impedance device 31. Therefore, when the switching transistor M1 is turned off after some elapsed period, the data pulse rising due to the charge redistribution between the storage capacitor Cst and the parasitic capacitor Cgs is reduced, and thus, revising the distorted displacement of the data pulse of the pixel 41 that is separated from the scan driver 20 by some distance.

That is, the impedance device 31 introduces the RC delay near the scan driver 20, thereby distorting a pulse at the output side of the scan driver 20 in order to make it substantially equal to the pulse distortion range of the pixel 41 separated from the scan driver by some distance.

Therefore, by matching the load impedance between the scan driver 20 and the pixel 41 separated from the scan driver 20 by some distance, the displacement range of the waveform due to the kickback voltage ΔVp is made substantially the same. This way, a phenomenon where the luminance of the pixels 41 is not uniform due to the variation of the distortion of data by the kickback voltage, based on the distance from the scan driver 20 and the number of devices and wirings, generated in the conventional EL display, is prevented.

Figure 6:
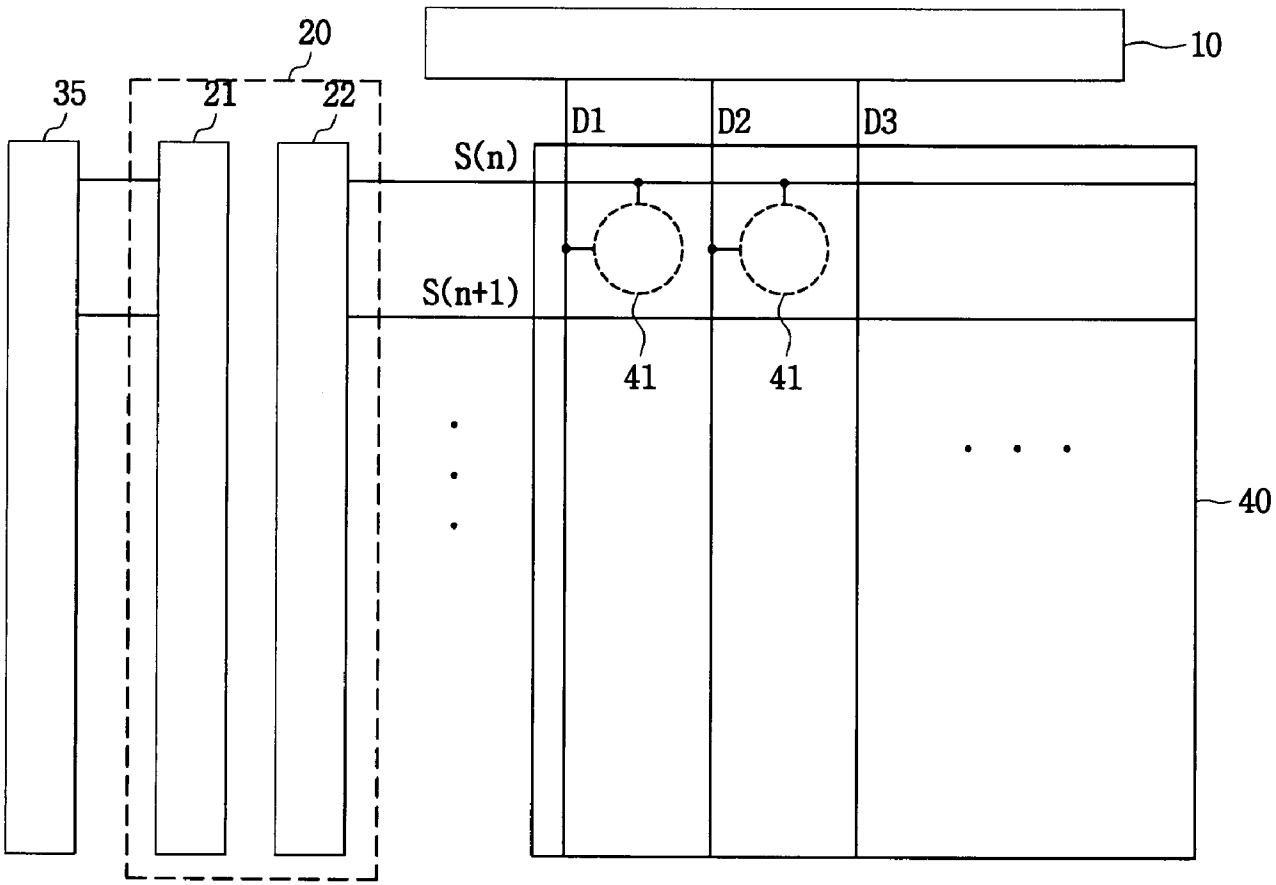
FIG. 6 is a block diagram illustrating a second exemplary embodiment of the EL display according to the present invention.

FIG. 6 is a block diagram illustrating a second exemplary embodiment of the present invention.

The control signal supplied by the control unit (not shown) is applied to the scan driver 20 through a signal delay device 35. The shift register 21 in the scan driver 20 generates a select signal for a selected scan line, and the level shifter 22 in the scan driver 20 raises up the voltage of the selection signal and outputs the amplified selection signal to the organic EL panel 40 as described above in reference to FIG. 4. Here, the signal delay device 35 introduces an RC delay at the input side of the scan driver 20, and makes a data of the pixel 41 near the scan driver 20 have substantially the same distorted displacement as the distorted pulse of the pixel 41 separated from the scan driver 20 by some distance.

Figure 7:
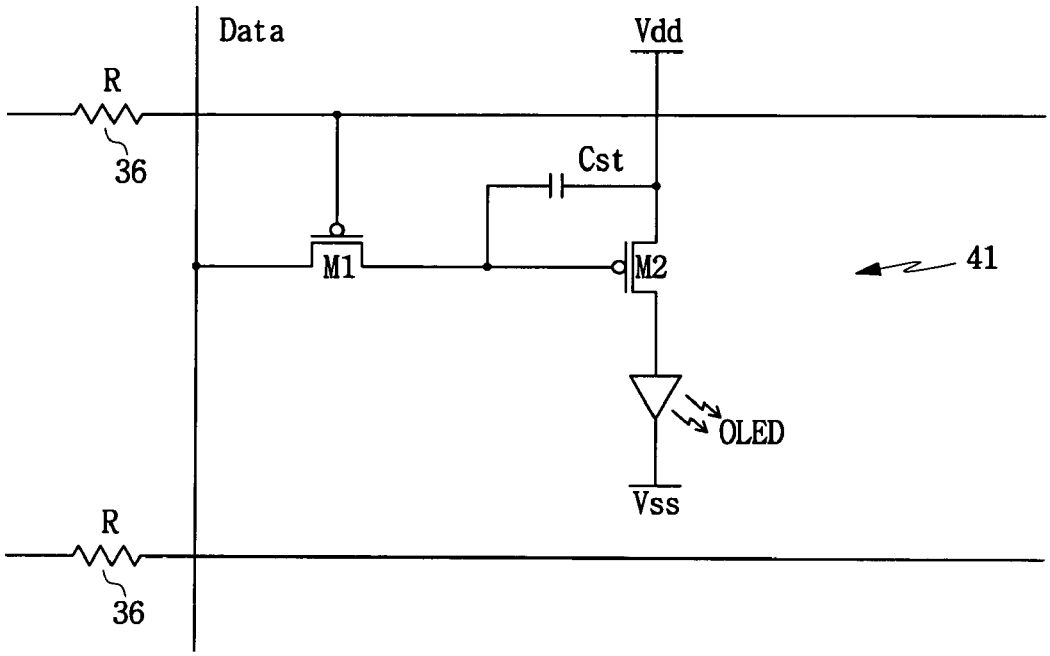
FIG. 7 is a circuit diagram illustrating a third exemplary embodiment of the present invention.

FIG. 7, which is a third exemplary embodiment of the present invention, is a circuit diagram employing a resistor as the signal delay device.

As shown in FIG. 7, in the signal delay device 36, when connecting a resistor R to the output side of the level shifter 22 as the impedance device, the RC delay occurs due to the parasitic capacitor Cgs, the storage capacitor Cst, and the resistor R, so that, for the data voltage Vdata applied to a gate of the driving transistor M2, the displacement range of the distorted waveform due to the kickback phenomenon of the pixel separated from the scan driver 20 by some distance is substantially uniform.

Figure 8:
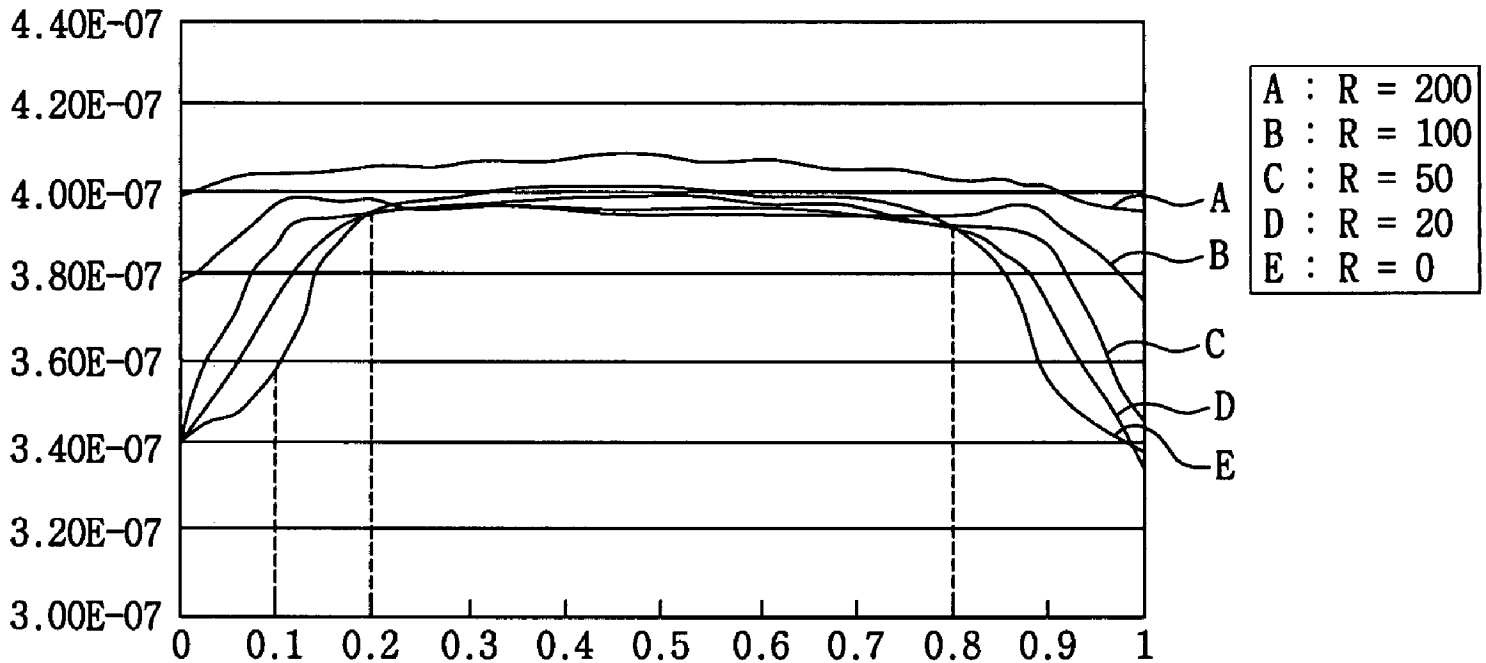
FIG. 8 illustrate graphs measuring a current of an organic EL device of pixel position in reference to resistor values.

FIG. 8 is a graph measuring a driving current of the organic EL device.

The graph shown in FIG. 8 illustrates a current graph of the organic EL device at the specific position, where A is a current of EL device according to position of display for R=200 ohms, B for R=100 ohms, C for R=150 ohms, D for R=20 ohms, and E for R=0 ohm, and X-Position indicates a position on the display. The graphs in FIG. 8 are substantially symmetric with respect to the center of the display (i.e., X=0.5 m) because they have been generated using an organic EL panel where a scan driver is located at both the horizontal ends (i.e., X=0 m and X=1 m) of the panel. For such an organic EL panel, an impedance matching device according to the exemplary embodiments of the present invention would be implemented between the panel and the left scan driver as well as the panel and the right scan driver.

As shown in FIG. 8, the graph E is a driving current of the organic EL device (OLED) where the resistor is not employed, showing a drastic change of displacement from 0 m to 0.2 m, and from 0.8 m to 1 m in X-Position. However, the graph of A is almost uniform where the largest driving current is measured, so that, as the resistor increases, the variation of rising displacement of the data voltage becomes smaller, and the driving current is increased to drive the organic EL device, i.e., organic light emitting diode (OLED).

Figure 9:
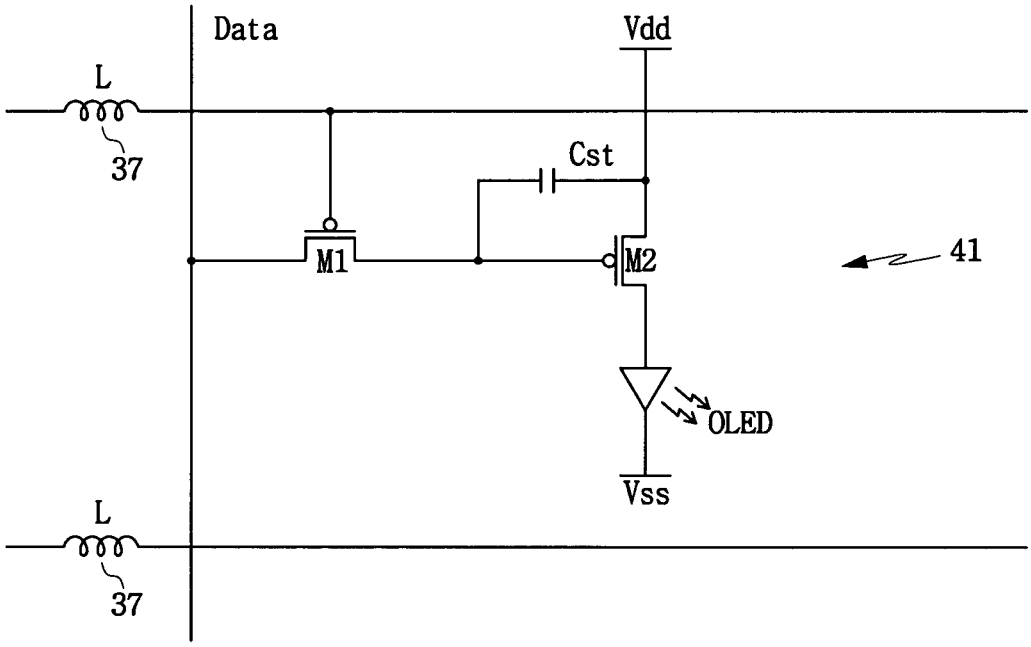
FIG. 9 is a circuit diagram illustrating a fourth exemplary embodiment of the present invention.
Figure 10:
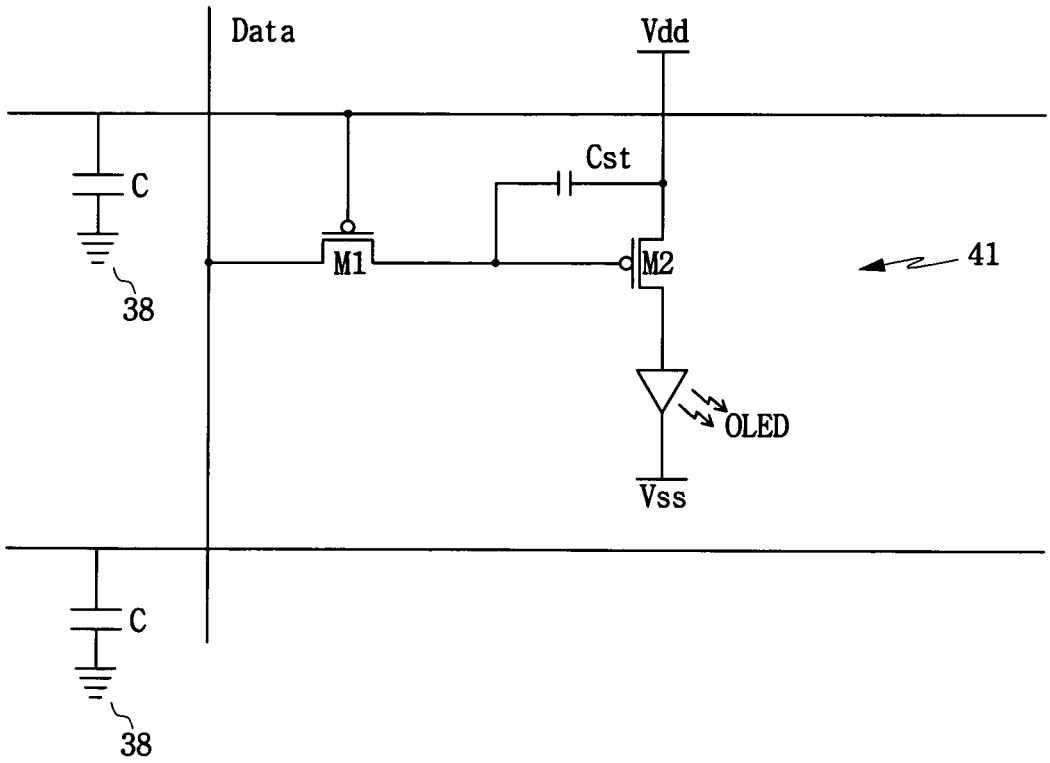
FIG. 10 is a circuit diagram illustrating a fifth exemplary embodiment of the present invention.

FIG. 9 illustrates a fourth exemplary embodiment of the present invention, and FIG. 10 illustrates a fifth exemplary embodiment of the present invention. As shown in FIGS. 9 and 10, in the fourth exemplary embodiment of the present invention, an inductor L 37 is connected to the output line of the level shifter 22, and in the fifth exemplary embodiment, a capacitor C 38 is connected to the output line of the level shifter 22, which redistributes charges along with the parasitic capacitor Cgs and the storage capacitor Cst of the organic EL panel 40, thereby reducing the pulse rising due to the kickback phenomenon. Therefore, the data voltage Vdata applied to the gate of the driving transistor M2 is substantially uniform in the displacement range as the distorted waveform of the scan pulse separated from the scan line by some distance. In still other embodiments, the signal delay device may include a combination of two or more of a resistor, a capacitor and an inductor.

While certain exemplary embodiments of the present invention are described above, the present invention is not limited to this, and also includes various types of modifications and changes made and practiced without departing from the spirit or scope of the present invention as embodied in the appended claims and equivalents thereof.

As described above, according to the EL display of the present invention, since the displacement of the waveform due to the kickback voltage falls within the same range irrespective of a distance between the scan driver and the pixel and the number of devices and wirings, by matching the impedance of the input side with the output side, a luminance of each organic EL device is made substantially uniform. Additionally, by introducing the RC delay only with a simple impedance device without having a separate compensation circuit, the non-uniformity of the luminance due to the kickback phenomenon is solved, thereby simplifying the manufacturing process and reducing the manufacturing cost.

What is claimed is:

1. An electroluminescent (EL) display comprising:

an organic EL panel comprising a plurality of scan lines, a plurality of data lines, and pixel circuits arranged at crossings between the scan lines and the data lines, each of the pixel circuits comprising a corresponding one of organic EL devices;

a scan driver comprising a shift register for sequentially selecting the scan lines to drive selection signals; and a signal delay device configured to delay the time all of the pixel circuits on the scan lines are selected, wherein the signal delay device is connected to an input side of the scan driver for reducing a kickback voltage on each of the selection signals of each of the scan lines such that a driving current become substantially the same across each of rows of the organic EL devices.

2. The EL display according to claim 1, wherein the scan driver further comprises a level shifter that amplifies an amplitude of a signal transmitted by the shift register, and wherein the signal delay device is at an input side of at least one of the shift register or the level shifter.

3. The EL display according to claim 2, wherein the signal delay device is an impedance device.

4. The EL display according to claim 3, wherein the impedance device comprises a resistor.

5. The EL display according to claim 3, wherein the impedance device comprises an inductor.

6. The EL display according to claim 3, wherein the impedance device comprises a capacitor.

7. The EL display according to claim 1, wherein the signal delay device is an impedance matching device.

8. The EL display according to claim 7, wherein the impedance matching device comprises a resistor.

9. The EL display according to claim 7, wherein the impedance matching device comprises an inductor.

10. The EL display according to claim 7, wherein the impedance matching device comprises a capacitor.

11. A method of making a luminance of organic electroluminescent (EL) devices in an organic EL panel substantially uniform, the organic EL panel comprising a plurality of scan lines coupled to rows of the EL devices and being driven by a scan driver comprising a shift register, the method comprising:

generating a plurality of selection signals in the scan driver utilizing the shift register to sequentially select each of the scan lines;

generating a data signal for providing data to a column of the organic EL devices; and reducing a kickback voltage on each of the selection signals of each of the scan lines by introducing a delay to each of the selection signals utilizing a plurality of signal delay devices coupled to the scan driver to delay the time all of the pixel circuits on each of the scan lines is selected, such that a driving current becomes substantially the same across each of the rows of the organic EL devices.

12. The method of claim 11, wherein said introducing a delay comprises implementing the signal delay devices between the scan driver and the organic EL panel.

13. The method of claim 12, wherein the signal delay devices each include at least one of a resistor, a capacitor or an inductor.

14. The method of claim 11, wherein said introducing a delay comprises implementing the signal delay devices at an input side of the scan driver.

15. The method of claim 14, wherein the signal delay devices each include at least one of a resistor, a capacitor or an inductor.

16. The method of claim 11, wherein the scan driver further comprises a level shifter for amplifying an amplitude of the select signal transmitted by the shift register, and wherein said introducing a delay comprises implementing the signal delay devices in the shift register.

17. The method of claim 11, wherein the scan driver further comprises a level shifter for amplifying the select signal transmitted by the shift register, and wherein said introducing a delay comprises implementing the signal delay devices in the level shifter.

18. An electroluminescent (EL) display comprising:

an organic EL panel comprising a plurality of scan lines, a plurality of data lines, and pixel circuits arranged at crossings between the scan lines and the data lines, each of the pixel circuits comprising a corresponding one of organic EL devices;

a scan driver comprising a shift register for sequentially selecting the scan lines to drive selection signals; and a signal delay device configured to delay the selection signals driven to all of the pixel circuits on each of the scan lines, wherein the signal delay device is connected to an output side of the scan driver for reducing a kickback voltage on each of the selection signals of each of the scan lines such that a driving current become substantially the same across each of rows of the organic EL devices.

19. The EL display according to claim 18, wherein the scan driver further comprises a level shifter that amplifies an amplitude of a signal transmitted by the shift register, and wherein the signal delay device is at an output side of at least one of the shift register or the level shifter.

20. The EL display according to claim 18, wherein the signal delay device is connected between the scan driver and the organic EL panel.

* * * * *

UNITED STATES PATENT AND TRADEMARK OFFICE

CERTIFICATE OF CORRECTION

PATENT NO. : 7,750,873 B2
APPLICATION NO. : 10/931925
DATED : July 6, 2010
INVENTOR(S) : Keum-Nam Kim It is certified that error appears in the above-identified patent and that said Letters Patent is hereby corrected as shown below:

| | |
|---|---|
| Column 6, Claim 1, line 46 | Delete “become” Insert -- becomes -- |
| Column 8, Claim 18, line 23 | Delete “become” Insert -- becomes -- |

Signed and Sealed this
Tenth Day of January, 2012

David J. Kappos

David J. Kappos
*Director of the United States Patent and Trademark Office*